United States Patent [19]

Cleusix

[11] Patent Number: 4,893,292

[45] Date of Patent: Jan. 9, 1990

[54] ELECTRONIC WATCH MOVEMENT COMPRISING TIME DISPLAY MEANS HAVING INDICATOR HANDS

[75] Inventor: Willy Cleusix, Le Landeron, Switzerland

[73] Assignee: ETA SA Fabriques d'Ebauches, Switzerland

[21] Appl. No.: 181,294

[22] PCT Filed: Aug. 3, 1987

[86] PCT No.: PCT/CH87/00094

§ 371 Date: Apr. 6, 1988

§ 102(e) Date: Apr. 6, 1988

[87] PCT Pub. No.: WO88/01071

PCT Pub. Date: Feb. 11, 1988

[30] Foreign Application Priority Data

Aug. 7, 1986 [CH] Switzerland ..... 03176/86

[51] Int. Cl.[4] ..... G04B 37/00; G04B 19/02

[52] U.S. Cl. ..... 368/88; 368/220; 368/318; 368/323

[58] Field of Search ..... 368/88, 76, 80, 220, 368/223, 318, 322, 323, 324

[56] References Cited

U.S. PATENT DOCUMENTS

| | | | |
|---|---|---|---|
| 4,087,957 | 5/1978 | Miyasaka et al. | 368/187 |
| 4,249,251 | 2/1981 | Wutarich | 368/76 |
| 4,335,454 | 6/1982 | Yamada | 368/220 |
| 4,496,246 | 1/1985 | Ota et al. | 368/88 |

FOREIGN PATENT DOCUMENTS

| | | |
|---|---|---|
| 0082110 | 6/1983 | European Pat. Off. . |
| 57-161578 | 10/1982 | Japan . |
| 0615068 | 7/1977 | Switzerland . |

OTHER PUBLICATIONS

Patent Abstracts of Japan, vol. 6, No. 265 (P-165) (1143), 24 Dec. 1982.

*Primary Examiner*—Vit W. Miska

*Attorney, Agent, or Firm*—Pollock, Vande Sande & Priddy

[57] ABSTRACT

The movement comprises a bottom-plate (1), a gear-train bridge (2), a center gear (14), an hour wheel (24) and a cell (25). The center gear (14) has a shaft (15) and a wheel (19) frictionally mounted on the shaft (15). Within the thickness of the movement, the frictionally mounted wheel (19) is adjacent the cell (25) to one side and the hours wheel (24) to the other side. The movement is so designed that the center gear (14) and the hours wheel (24) may be fitted into place at the very end of the assembly process.

13 Claims, 2 Drawing Sheets

ELECTRONIC WATCH MOVEMENT COMPRISING TIME DISPLAY MEANS HAVING INDICATOR HANDS

BACKGROUND OF THE INVENTION

This invention relates to electronic watch movements comprising analog time display means and more particularly those having only an hours hand and a minutes hand.

Such movements are generally intended to watches of small size, e.g. ladies' watches. In such watches, it is desirable for the cell to be as close as possible to the center of the watch. To this end, the movement described in swiss patent specification 615068 comprises a bottom-plate on which is provided a central peg on the dial side. On this peg are pivotally mounted the cannon-pinion and the hours wheel, which respectively mesh with the minutes wheel and the minutes pinion. The kinematic connection with the rotor is thus solely provided by the minutes gear. This arrangement enables the center of the movement to be cleared and hence a cell of large diameter to be used, but gives rise to a major drawback: since the cannon-pinion is at the end of the kinematic chain provided by the gear-train and thus, necessarily, has only few teeth, the backlash is quite substantial. As a result, the position of the minutes hand becomes somewhat inaccurate, unless a brake is applied on the cannon-pinion. But such a brake would increase the energy consumption of the watch and a larger cell would then be needed to achieve a corresponding autonomy.

In the specification of Japanese patent application 57-161578, a movement is described having a bottom-plate, a gear-train bridge, a rotor, an intermediate gear and an hours wheel. The center gear has a shaft that is pivotally mounted between the bridge and the bottom-plate and on which a wheel web is frictionally mounted. The shaft takes up the entire height of the movement while the wheel web is housed in a space between the bottom-plate and the cell. This arrangement lends itself to the design of a watch in which the cell extends close to the center without giving rise to a backlash problem with the center gear. But this result is achieved at the expense of the thickness of the cell.

SUMMARY OF THE INVENTION

An object of the invention is to remedy these defects with a constructional arrangement that still makes it feasible for a cell to extend as close as possible to the center of the movement, and with a cell thickness almost equal to the height of the movement.

According to the invention, the invention provides an electronic watch movement comprising a bottom-plate having a central opening, a cell, time display means having indicator hands, a motor and a gear-train connecting the motor to the indicator hands, said gear-train including an intermediate gear, a center gear having a shaft and having a wheel and a pinion solid with said shaft, a minutes gear and an hours wheel, having a pipe, rotatably mounted on said shaft directly over the wheel of said center gear, the wheel of said center gear meshing with teeth on said intermediate gear and extending over said cell, and the central opening in said bottom-plate having a diameter larger than that of the pinion of said center gear.

SHORT DESCRIPTION OF THE DRAWINGS

In the accompanying diagrammatic drawings, in which the same reference numbers are used to designate corresponding parts:

FIGS. 1 and 3 are cross-sections through a part of two movements according to the invention; and FIGS. 2 and 4 are again cross-sections through a part of the same movements but along a different line.

DETAILED DESCRIPTION

Figure 1:
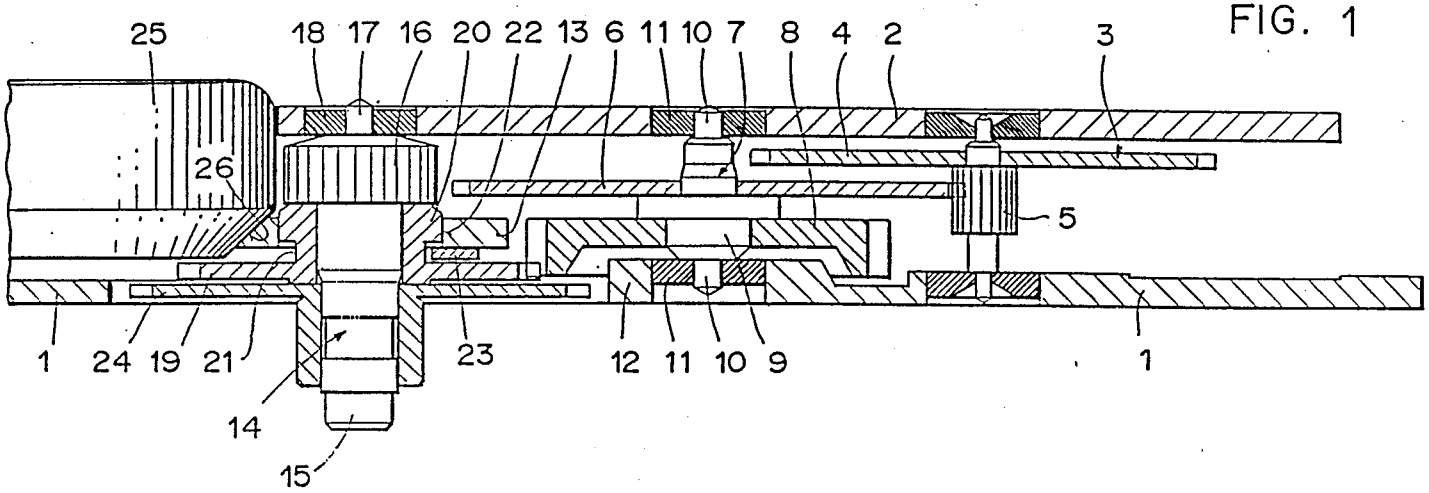
Figure 2:
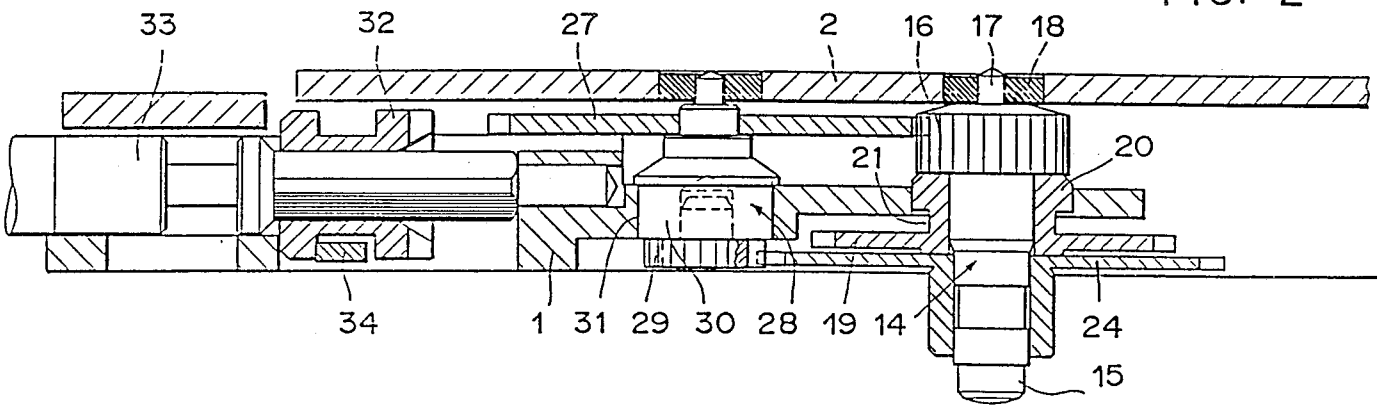

The movement shown in FIGS. 1 and 2 comprises a frame made up of a bottom-plate 1 and of a gear-train bridge 2. Between these two frame elements is mounted a motor, not shown, whose rotor has a pinion that meshes with a first intermediate gear 3, in particular with the wheel 4 thereof. The pinion 5 of gear 3 meshes with the wheel 6 of a second intermediate gear 7 whose pinion 8 consists of a toothed dish-like disc solid with shaft 9 of gear 7. Shaft 9 has two pivots 10 each engaged in a jewel 11. One of these jewels is set into a hole provided in bottom-plate 1 at the center of a boss 12 that projects inwardly of the movement. Bottom-plate 1 is also formed with a central recess 1*a* whose bottom 13 is burst to enable toothed disc 8 to mesh with a center gear 14 which will now be described. Center gear 14 has a shaft 15 integral with its pinion 16 and a pivot 17. Pivot 17 is supported by a bearing 18 provided by a jewel that is set in a hole formed in bridge 2. Center gear 14 further comprises a wheel 19 having a toothed web 19*a*, a boss 19*b*, a collar 20 adjacent web 19*a* and, between web 19*a* and collar 20, a circumferential groove 21 coaxial with gear 14. Wheel 19 has the same number of teeth as toothed disc 8. These two elements mesh when the center gear is fitted into place. Collar 20 has an outer diameter which is slightly larger than that of pinion 16. Collar 20 rotatably engages in a hole 22 formed in the bottom 13 of central recess 1*a* in bottom-plate 1. Consequently, hole 22 defines a central opening in botom-plate 1 which is larger than center pinion 16.

Wheel 19 is frictionally mounted on shaft 15. These two parts are thus solid with one another. The pivotal motion of center gear 14 is ensured firstly by collar 20, engaged in hole 22, and secondly by pivot 17, engaged in jewel 18. In the described form of embodiment, an elastic locking element 23 that is secured by a screw to the bottom 13 of recess 1*a* in bottom-plate 1 blocks center gear 14 axially but, as will be apparent later, this arrangement is not essential.

As in a normal movement, the time display means include an hours wheel 24, having a pipe portion, which is rotatably mounted on shaft 15 of center gear 14 over wheel 19 and ears on boss 19*b*. The pipe portion of wheel 24 is intended to carry an hours hand, not shown, while the end portion of shaft 15 of center gear 14 is intended to carry a minutes hand, not shown either.

Cell 25 for energizing the movement is put in place from the back of the movement into a hollow or a hole in gear-train bridge 2. It bears against a beveled surface 26 on bottom 13 of central recess 1*a* in bottom-plate 1. Between the top surface of cell 25 and the portion of bottom-plate 1 that extends over cell 25 sufficient space is provided to accommodate an electrical connection tongue, not shown. Wheel 19 also extends into this space, while the web of hours wheel 24 extends in the plane of the upper portion of bottom-plate 1. Radically, cell 25 extends to a distance from the center of the movement that is slightly larger than the radius of pinion 16.

Wheels 19 and 24 are also visible in FIG. 2. Pinion 16 meshes with the wheel 27 of a minutes gear 28 having a pinion 29 that is driven into a collar 30. Collar 30 has a diameter slightly larger than that of pinion 29 and is rotatably mounted in a hole 31 in bottom-plate 1. Minutes pinion 29 meshes with hours wheel 24 whilst minutes wheel 27, which meshes with center pinion 16, may also be driven manually upon displacement of a sliding pinion 32 along the square of a control stem 33. The latter extends radially in the movement. A lever 34 and a pull-out piece, not shown, move sliding pinion 32 in the usual way when stem 33 is pulled outwardly into its time-setting position. This design for the movement thus involves no setting wheel in the time-setting mechanism.

Figure 3:
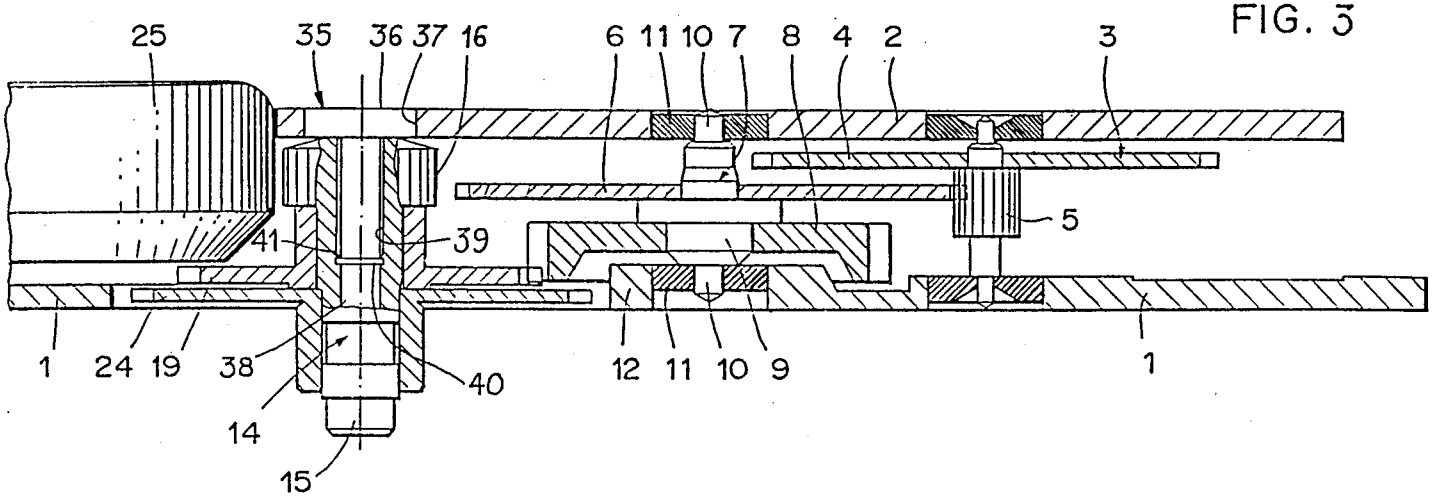
Figure 4:
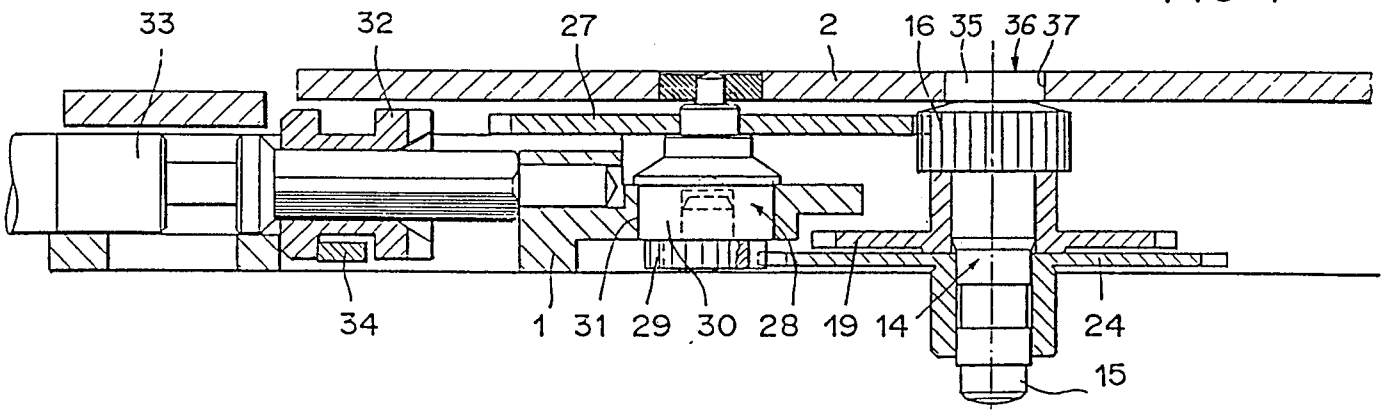

The movement shown in FIGS. 3 and 4 mainly differs from the first in that center gear 14 is rotatably mounted on a peg 35 secured in gear-train bridge 2. More specifically, peg 35 has a seat 36 that is force-fitted into a hole 37 in bridge 2, and a pivot 38 that rotatably engages into a hole 39 in shaft 15 to enable the latter to pivot. Pivot 38 and shaft 15 each have an annular rib, 40 and 41 respectively, which ribs are adapted to interengage to define an axial snap arrangement for axially positioning center gear 14. Further, center wheel 19 does not here have a collar nor a groove, center gear 14 being guided and positioned by peg 35 alone. In this embodiment also, bottom-plate 1 instead of having a recess in its center is formed with a plain central opening **1*b* through which the entire center gear 14 along with center wheel 19 and hours wheel 24** may be fitted into place.

In both of the above described embodiments, the minutes hand is borne by a shaft driven by a wheel of large diameter, i.e. center wheel 19, thereby considerably reducing backlash. Nonetheless, the space available heightwise within the movement for receiving the cell exceeds 60% and may be as much as 90% of the thickness of the movement, despite the fact that the cell comes to within the immediate vicinity of the movement's center.

This arrangement also has an interesting complementary advantage, as it enables center gear 14 and hours wheel 24 to be put into place after the movement has otherwise been fully assembled. In the first embodiment, it suffices to engage pivot 17 into the hole of jewel 18 and to cause collar 20 to penetrate hole 22 in bottom-plate 1. In the second embodiment, center gear 14 is simply engaged over pivot 38. this enables movements to be stocked without a center gear and without an hours wheel and enables the selection, at the time of delivery, of a center gear and of an hours wheel in dependence on the height of the hands assembly. It might even be possible to mount the minutes hand and the hours hand on the center gear and on the hours wheel respectively, with the dial being sandwiched in between, the resulting module being then fitted to the watch movement.

What is claimed is:

1. An electronic watch movement comprising a bottom-plate having a central opening, a cell, time display means having indicator hands, a motor and a gear-train connecting the motor to the indicator hands, said gear-train including an intermediate gear, a center gear having a shaft and having a wheel and a pinion solid with said shaft, a minutes gear and an hours wheel, having a pipe, rotatably mounted on said shaft directly over the wheel of said center gear, the wheel of said center gear meshing with teeth on said intermediate gear and extending over said cell, and the central opening in said bottom-plate having a diameter larger than that of the pinion of said center gear.

2. A movement according to claim 1, wherein the wheel of said center gear and the hours wheel are accommodated in an outwardly-opening recess in said bottom-plate.

3. A movement according to claim 2, wherein said center gear has, between its wheel and its pinion, a collar having a diameter larger than that of said pinion and which guides said center gear during rotation in the central opening provided in the bottom of said bottom-plate recess.

4. A movement according to claim 3, wherein said center gear further comprises a pivot rotatably mounted in a bearing solid with a gear-train bridge.

5. A movement according to claim 1, wherein the wheel of said center gear and the pinion of said intermediate gear have the same number of teeth.

6. A movement according to claim 1, wherein said center gear is axially held in place by a locking element that engages in a circumferential groove co-axial with said center gear and located in the latter between its wheel and its pinion.

7. A movement according to claim 1, further comprising a gear-train bridge having a peg extending towards said bottom-plate and engaged in an axial hole comprised by said center gear to rotatably mount said center gear on said peg.

8. A movement according to claim 7, wherein said peg and the wall of said hole are each formed with an annular rib, said ribs being interengageable to define an axial snap for axially positioning said center gear on said peg.

9. A movement according to claim 2, wherein said center gear is axially held in place by a locking element that engages in a circumferential groove co-axial with said center gear and located in the latter between its wheel and its pinion.

10. A movement according to claim 3, wherein said center gear is axially held in place by a locking element that engages in a circumferential groove co-axial with said center gear and located in the latter between its wheel and its pinion.

11. A movement according to claim 4, wherein said center gear is axially held in place by a locking element that engages in a circumferential groove co-axial with said center gear and located in the latter between its wheel and its pinion.

12. A movement according to claim 5, wherein said center gear is axially held in place by a locking element that engages in a circumferential groove co-axial with said center gear and located in the latter between its wheel and its pinion.

13. A gear for use in a timepiece having a shaft, a pivot at one end of the shaft, a pinion integral with said shaft and a separate wheel, integral with a journal-forming collar and solid with said shaft, wherein said collar has a diameter greater than that of said pinion and is located between said wheel and said pinion for guiding said gear during rotation thereof in an opening provided in a plate of said timepiece.

* * * * *